US011097164B2

(12) United States Patent
Krysiak et al.

(10) Patent No.: US 11,097,164 B2
(45) Date of Patent: Aug. 24, 2021

(54) BASKETBALL HAVING IMPROVED PEBBLED TEXTURE

(71) Applicant: Wilson Sporting Goods Co., Chicago, IL (US)

(72) Inventors: Kevin L. Krysiak, Palatine, IL (US); Rayna L. S. Kearney, Schaumburg, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 16/598,781

(22) Filed: Oct. 10, 2019

(65) Prior Publication Data

US 2021/0106880 A1 Apr. 15, 2021

(51) Int. Cl.
*A63B 41/08* (2006.01)
*A63B 41/02* (2006.01)

(52) U.S. Cl.
CPC ..... *A63B 41/08* (2013.01); *A63B 41/02* (2013.01); *A63B 2209/00* (2013.01); *A63B 2243/0037* (2013.01)

(58) Field of Classification Search
CPC ..... A63B 41/08; A63B 41/02; A63B 2209/00; A63B 2243/0037; A63B 2243/007
See application file for complete search history.

(56) References Cited

U.S. PATENT DOCUMENTS 2,448,731 A 9/1948 Park
2,859,040 A * 11/1958 Gow ..... A63B 41/08 473/596
2,931,653 A * 4/1960 Gow ..... A63B 41/08 473/596
4,000,894 A 1/1977 Butzen
4,284,398 A 8/1981 Bokelmann
4,312,827 A 1/1982 Bokelmann
4,570,931 A * 2/1986 Martin ..... A63B 39/06 473/596
4,928,962 A 5/1990 Finley
4,991,842 A * 2/1991 Finley ..... A63B 41/08 40/327

(Continued)

OTHER PUBLICATIONS

Definition of "Surround", <https://www.merriam-webster.com/dictionary/surround>, retrieved on Feb. 18, 2021. (Year: 2021).*

*Primary Examiner* — Steven B Wong
(74) *Attorney, Agent, or Firm* — Terence P. O'Brien

(57) ABSTRACT

A generally spherical basketball defining a center point and including a carcass having an outer surface and a cover assembly positioned over the outer surface of the carcass. The cover assembly includes at least one cover panel. The cover panel has an outer surface including a valley base surface and first and second sets of spaced-apart projections. Each of the projections of the first and second sets of spaced-apart projections include first and second outermost surfaces, respectively. The first set of projections have an average height measured in a radial direction from the center point within the range of 0.2 to 2.0 mm from the valley base surface to the first outermost surface. The second set of projections have an average height measured in a radial direction from the center point within the range of 15 to 175 μm from the valley base surface to the second outermost surface.

20 Claims, 10 Drawing Sheets

(56) References Cited

U.S. PATENT DOCUMENTS 5,310,178 A * 5/1994 Walker ..... A63B 41/08 273/DIG. 8
5,320,345 A 6/1994 Lai et al.
5,419,552 A 5/1995 Meyer
5,427,372 A * 6/1995 Ratner ..... A63B 41/08 156/147
5,494,625 A 2/1996 Hu
5,518,234 A 5/1996 Palmquist
5,669,838 A * 9/1997 Kennedy ..... A63B 41/08 473/596
5,681,233 A 10/1997 Guenther et al.
5,931,752 A * 8/1999 Guenther ..... A63B 41/08 473/597
5,984,812 A 11/1999 Sassak
6,024,661 A * 2/2000 Guenther ..... A63B 41/08 473/599
6,123,633 A 9/2000 Guenther et al.
6,283,881 B1 * 9/2001 Feeney ..... A63B 41/08 473/596
RE37,468 E * 12/2001 Kennedy ..... A63B 41/08 473/596
6,520,877 B1 * 2/2003 Yang ..... A63B 41/08 473/597
D478,641 S 8/2003 Kuehne
6,612,948 B1 * 9/2003 Miller ..... A63B 41/08 473/596
6,645,099 B2 11/2003 Gaff et al.
6,685,584 B2 * 2/2004 Jin ..... A63B 37/14 473/596
D516,643 S 3/2006 Kuehne et al.
D516,644 S 3/2006 Kuehne et al.
D517,137 S 3/2006 Kuehne et al.
D517,621 S 3/2006 Kuehne et al.
D544,052 S 6/2007 Krysiak
D544,053 S 6/2007 Krysiak
7,300,369 B2 11/2007 Krysiak et al.
D569,927 S 5/2008 Kuehne et al.
7,585,236 B2 9/2009 Krysiak
7,699,727 B2 4/2010 Guenther et al.
7,758,458 B2 * 7/2010 Fujisawa ..... D06N 3/0077 473/597
7,892,120 B2 2/2011 Krysiak
7,909,715 B2 3/2011 Krysiak
D644,702 S 9/2011 Krysiak
D645,101 S 9/2011 Krysiak
8,047,937 B2 11/2011 Krysiak
8,133,570 B2 * 3/2012 Fujisawa ..... A63B 41/08 428/141
8,142,311 B2 3/2012 Krysiak
8,251,846 B2 8/2012 Krysiak
8,460,136 B2 6/2013 Krysiak
D685,868 S 7/2013 Krysiak et al.
8,579,742 B2 11/2013 Krysiak
8,740,734 B2 6/2014 Krysiak
9,114,286 B2 8/2015 Krysiak et al.
9,802,082 B1 * 10/2017 Calandro ..... A63B 43/004
9,901,786 B2 2/2018 Krysiak et al.
10,022,593 B2 7/2018 Krysiak et al.
D836,734 S 12/2018 Davenport et al.
10,525,311 B2 1/2020 Kolcun et al.
2005/0058794 A1 * 3/2005 Fujisawa ..... A63B 71/14 428/35.7
2005/0153803 A1 7/2005 Swiszcz
2006/0046879 A1 * 3/2006 Kelly ..... A63B 41/08 473/603
2008/0305900 A1 * 12/2008 Geisendorfer ..... A63B 41/08 473/596
2009/0325742 A1 * 12/2009 Krysiak ..... A63B 41/08 473/596
2015/0045159 A1 * 2/2015 Tompkins ..... A63B 45/00 473/596

* cited by examiner

BASKETBALL HAVING IMPROVED PEBBLED TEXTURE

FIELD OF THE INVENTION

The present invention relates generally to sport game balls. In particular, the present invention relates to a basketball having an improved pebbled texture to improve the playability of the basketball.

BACKGROUND OF THE INVENTION

Game balls for sports such as basketballs, footballs, soccer balls, volleyballs, rugby balls, baseballs and softballs are well known. Many game balls, such as basketballs, typically include an inflatable bladder covered with a layer of windings and encased in a layer of elastomeric material, typically molded in a carcass-forming mold to form the carcass of the ball. One or more additional layers of material, such as a cover or padding may be placed over portions, or all, of the outer surface of the carcass to form the basketball. Covers of game balls are commonly formed of rubber, leather, synthetic leather or a polymeric material.

Game ball designers face a number of challenges. One such challenge is to produce a game ball with improved gripping and tactile characteristics. One approach used to increase the gripping and tactile characteristics of the outer surface of game balls, such as basketballs and footballs, typically includes a pebbled texture to improve the gripability of the ball.

Although the use of a pebbled outer surface has improved the performance of these products, further improving the gripping and tactile characteristics of game balls is desired. In basketball and football, as in many other sports, the gripping and tactile characteristics of the game ball can considerably affect the performance of the participating players. In particular, the gripability of the outer surface of the game ball can significantly affect the player's ability to catch, retain or dribble the ball effectively, and to pass or shoot the game ball accurately. Further, in game conditions, players' perspiration, or the game-time weather conditions, can negatively affect the player's ability to properly grip the ball for passing, catching, shooting and dribbling.

There is an ever present need to improve the feel of the game balls during use. A game ball with an improved feel can improve a player's level of play. There is also a continuing desire to produce a game ball with an improved aesthetic. Moreover, it is desirable to maximize the feel and gripability of the game ball at an affordable price. What is needed is a cost effective method of producing a game ball with improved gripping and tactile characteristics.

SUMMARY OF THE INVENTION

The present invention provides a generally spherical basketball defining a center point and including a carcass having an outer surface and a cover assembly positioned over the outer surface of the carcass. The cover assembly includes at least one cover panel. The at least one cover panel has an outer surface including a valley base surface and first and second sets of spaced-apart projections. Each of the projections of the first and second sets of spaced-apart projections include a respective outermost surface. The first set of projections have an average height measured in a radial direction from the center point within the range of 0.2 to 2.0 mm from the valley base surface to the outermost surface. The second set of projections have an average height measured in a radial direction from the center point within the range of 15 to 175 μm from the valley base surface to the outermost surface.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
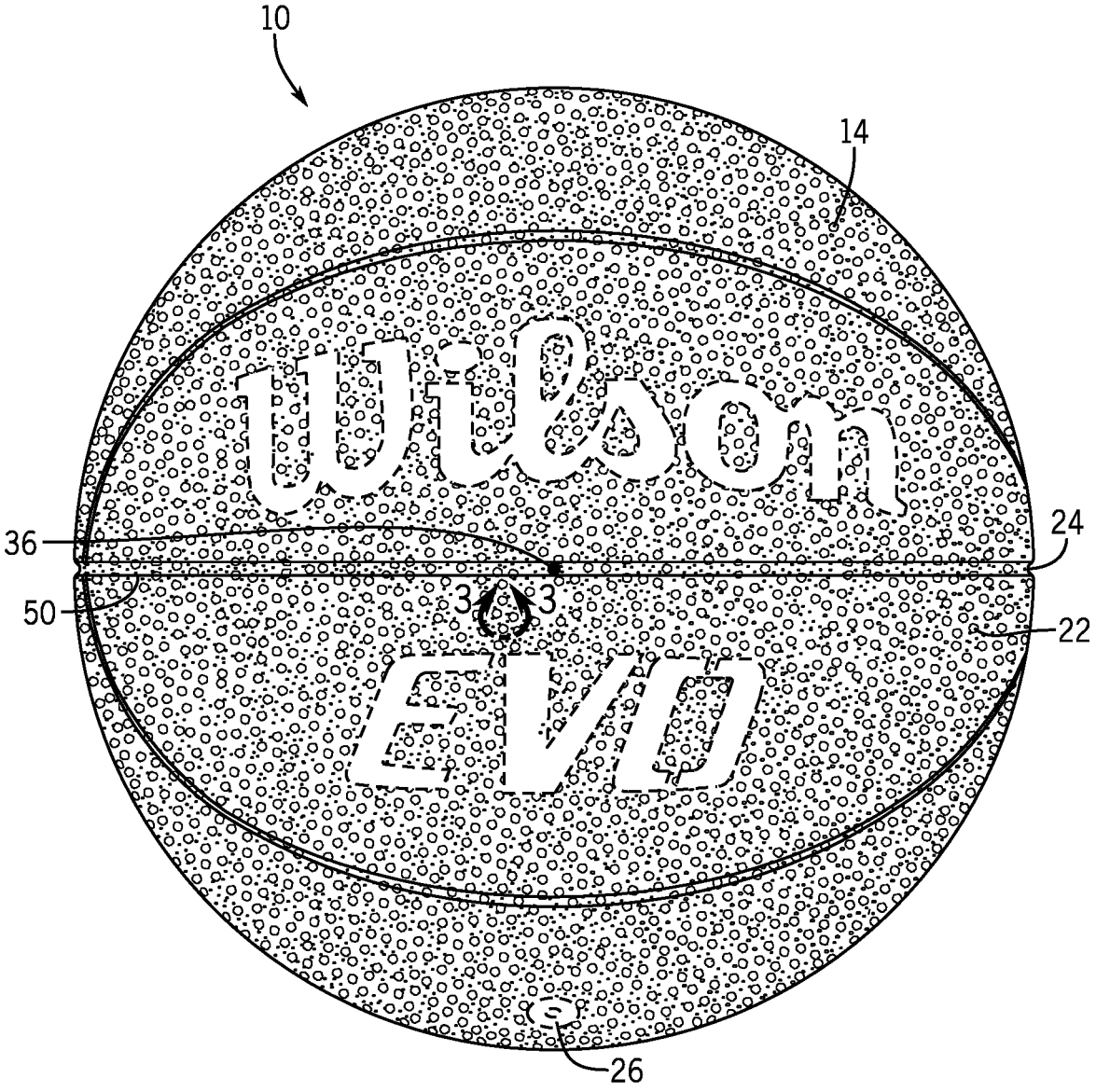
FIG. 1 is a front perspective view of a generally spherical basketball in accordance with a preferred embodiment of the present invention.
Figure 2:
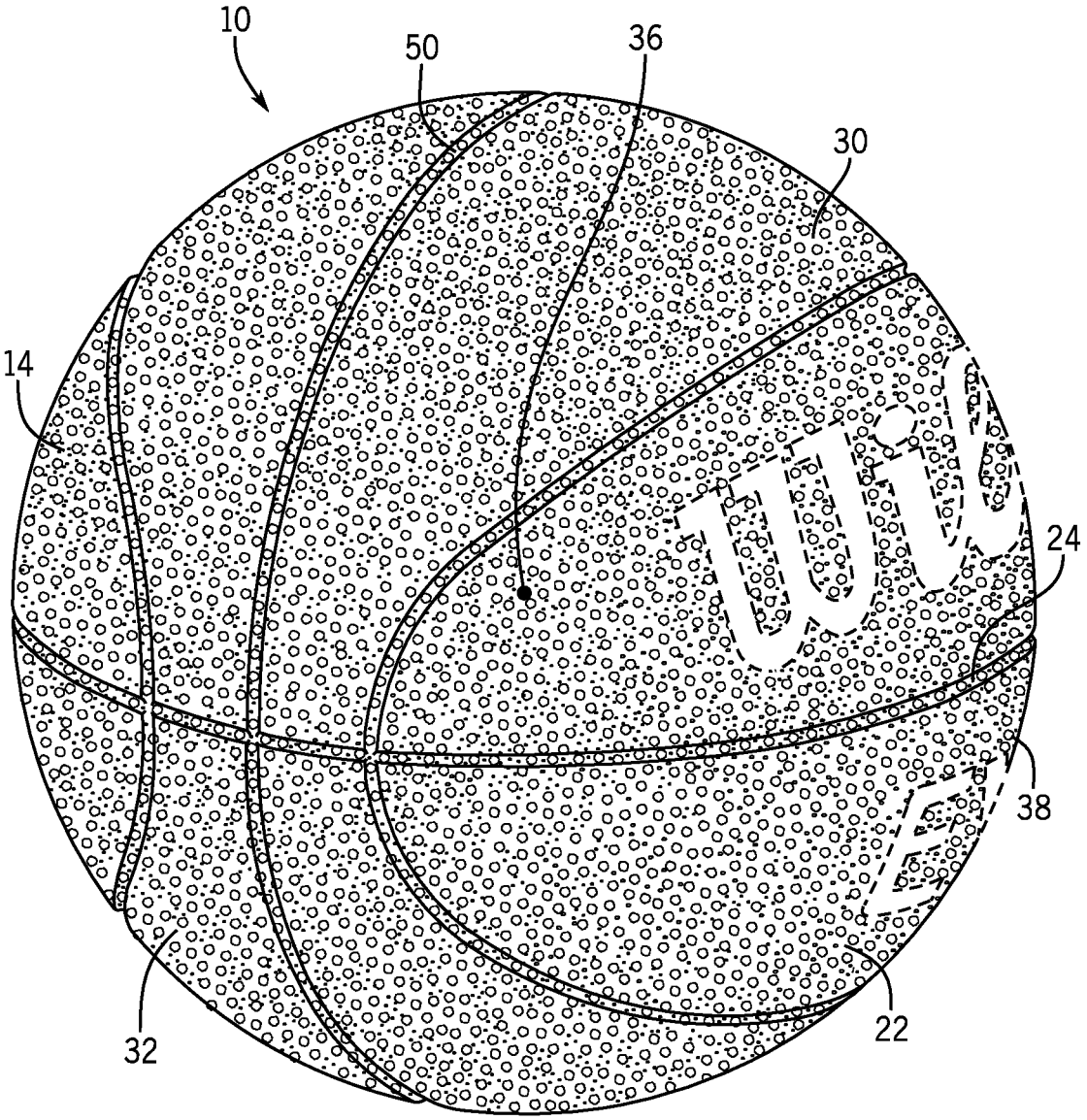
FIG. 2 is a first side perspective view of the basketball of FIG. 1.

Referring to FIGS. 1, 2 and 4, a basketball is indicated generally at 10. The basketball 10 is one example of a game ball. The present application is directly applicable to other games balls, including, for example, footballs, rugby balls, soccer balls, and volleyballs.

The basketball 10 is a generally spherical inflatable object defining a center point 36. The basketball 10 is preferably includes a carcass 12 and a cover assembly 14. The carcass 12 is a combination of ball components that are molded in a carcass-forming mold to produce an inflatable ball structure. In one preferred embodiment, the carcass 12 includes a bladder 16, a layer of windings 18 and at least one layer of elastomeric material 20. The cover assembly 14 includes a plurality of cover attachment pieces. In one preferred embodiment, the cover assembly 14 includes a plurality of cover panels 22. The cover panels 22 are preferably spaced apart by a set of channels 24 or a set of outwardly extending ribs.

The bladder 16 of the carcass 12 is an inflatable air tube preferably having a generally spherical shape. The bladder 16 is disposed within the windings 18. The bladder 16 enables the basketball 10 to retain a predetermined amount of air thereby achieving the desired air pressure within, or firmness to, the basketball 10. The bladder 16 is typically made of latex, butyl rubber or other suitable material. The bladder 16 includes a valve 26 that extends through the windings 18, the layer of elastomeric material 20 and the cover assembly 14 for access by a user. In other implementations, the basketball can be formed without a bladder.

The layer of windings 18 of the carcass 12 includes one or more elongate threads, which are wound around, or applied to, the bladder 16. The threads form the layer of windings 14 that reinforces the bladder 16 and retains the generally spherical shape of the bladder 16. The threads of the windings 18 are formed of a high tensile strength material, preferably nylon. In alternative embodiments, the thread can be a textile, a wire, or other conventional thread material. In a particularly preferred embodiment, the layer of windings 18 is comprised of 2100 meters of 210 denier Nylon thread. In an alternative embodiment, the basketball can be formed without a layer of windings. In another alternative preferred embodiment, the layer of windings can be formed through one or more segments of adhesive tape, patches of a textile material, or similar material.

The layer of elastomeric material 20 of the carcass 12 is a generally spherical body disposed over the layer of windings 18. In a preferred embodiment, the layer of elastomeric material 20 is formed by placing a plurality of segments of elastomeric material onto an outer surface of the windings 18 and then molding the segments in a carcass-forming mold over the wound bladder 16 to produce a uniform spherical layer of elastomeric material. The layer of elastomeric material 20 can also be injected, or otherwise inserted, within a carcass forming mold. It is common for a portion of the layer of elastomeric material 20 to impregnate, bond to, or otherwise engage the layer of windings 18. The layer of elastomeric material 20 is, preferably, a sponge rubber. Alternatively, the carcass 16 can be made of other materials such as latex, a butyl rubber, a natural rubber, a synthetic polymeric plastic material, a cellular elastomeric material, a non-cellular elastomeric material or other elastomeric materials. In another alternative embodiment, the layer of elastomeric material 20 can be a multi-layered body including one or more layers of elastomeric and, optionally, a material fabric.

In one preferred embodiment, the carcass 12 is placed into a carcass-forming mold (not shown). The carcass-forming mold includes an arrangement of recesses, grooves, and/or projections to form the shape and structure of an outer surface 28 of the carcass 12, after the carcass 12 is molded and cured. In one implementation, the carcass-forming mold produces the set of elongate channels 24 on the outer surface 28. The set of elongate channels 24 define a plurality of cover attachment regions 30 about the outer surface 28 of the carcass 12. In one implementation, the carcass 12 defines at least two, and less than or equal to sixteen, cover attachment regions 30. In other implementations, the carcass defines eight, ten or twelve cover attachment regions 30. Each cover attachment region 30 is configured to receive at least one cover panel 22. The first set of elongate channels 24 can define a pattern resembling the pattern of channels or ribs found on a conventional basketball. In another implementation, the carcass can be formed without the set of channels. Alternatively, other pattern layouts can also be used. In another implementation, the carcass-forming mold produces the set of outwardly extending ribs on the outer surface 28. The set of ribs can define the plurality of cover attachment regions 30 about the outer surface 28 of the carcass 12. Accordingly, the set of ribs can be integrally formed with the layer of elastomeric material 20 and are part of the carcass 12.

The cover assembly 14 is preferably comprised of the plurality of cover panels 22. In one implementation, the cover assembly 14 includes at least two cover panels 22 and less than or equal to sixteen cover panels 22. In other implementations, the cover assembly 14 includes eight, ten or twelve cover panels 22. The cover panels 22 are single or multi-layered sheets of material that are coupled to the cover attachment regions 30 of the carcass 12. Preferably, the cover panels 22 are laminated to the cover attachment regions 30 of the carcass 12. Alternatively, the cover panels 22 can be attached to the carcass 12 by other means, such as, for example, stitching, molding, pressing, bonding, and combinations thereof. The cover panels 22 preferably include peripheral edges that extend to the elongate channels 24. The cover assembly 14 is configured for impact with one or more playing surfaces and for contact with players. In an alternative implementations, the cover assembly 14 can be connected directly to the bladder 12 or to the layer of windings 14.

The cover panels 22 preferably include an outer layer 32 coupled to a backing 34. The outer layer 32 is formed or applied to the backing 34 such that a portion of the outer layer 32 impregnates, extends into, or otherwise engages the backing 32. Alternatively, the outer layer 32 can be attached to the backing 34 through an adhesive, bonding, stitching, or other conventional means. The outer layer 32 is preferably formed of a wear-resistant, resilient material having a high coefficient of friction value (or a high level of grip-ability). The material used to produce the outer layer 32 can be a natural rubber, a butyl rubber, natural leather, synthetic leather, a polyurethane, a thermoplastic material, a thermoset material, or other synthetic polymeric materials.

The backing 34 is configured to increase the tensile strength of the cover panels 22. The backing 34 is made of a soft material, preferably a felt-like fabric. Alternatively, the backing 34 can be formed of other materials, such as, for example, other woven or unwoven fabrics, plastic, an elastomer, a rubber, and combinations thereof. The backing 34 is preferably configured to contact the outer surface 28 of the carcass 12. In an alternative preferred embodiment, the cover panels 22 can be formed without a backing. In a particularly preferred embodiment, peripheral regions of the backing 34 (and/or the outer layer 32) can be skived (tapered or thinned out) to produce a recess in the outer surface of the basketball 10 near the elongate channels 24. In alternative preferred embodiments, the thickness of the cover panel can remain generally constant over the entire cover panel.

Figure 3:
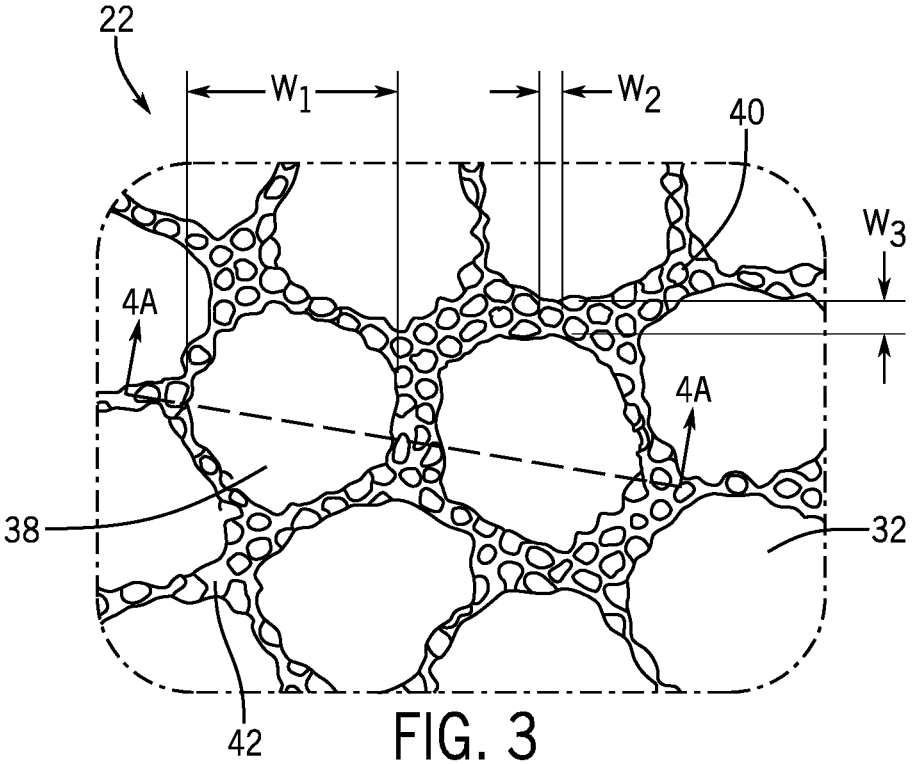
FIG. 3 is enlarged view of a portion of a cover panel of the basketball of FIG. 1 taken along line 3-3 of FIG. 1.
Figure 4A:
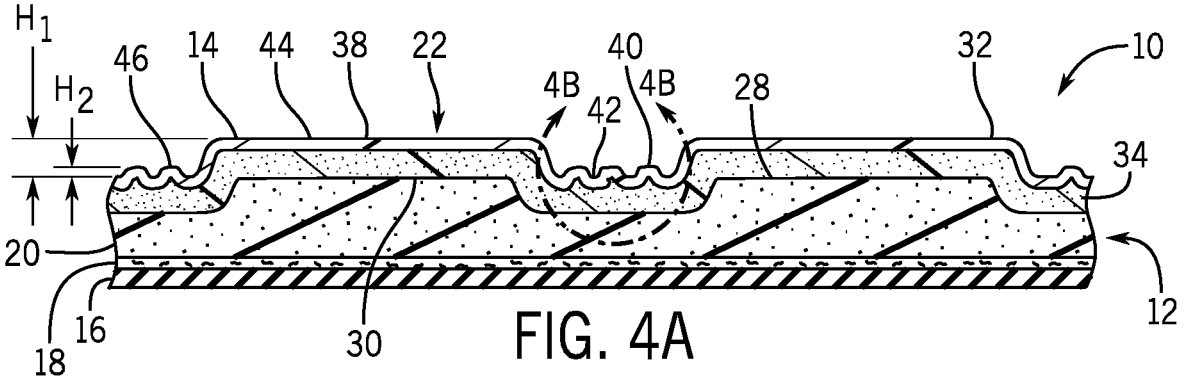
FIG. 4A is a cross-sectional view of the portion of the cover panel of the basketball taken along line 4A-4A of FIG. 3.
Figure 4B:
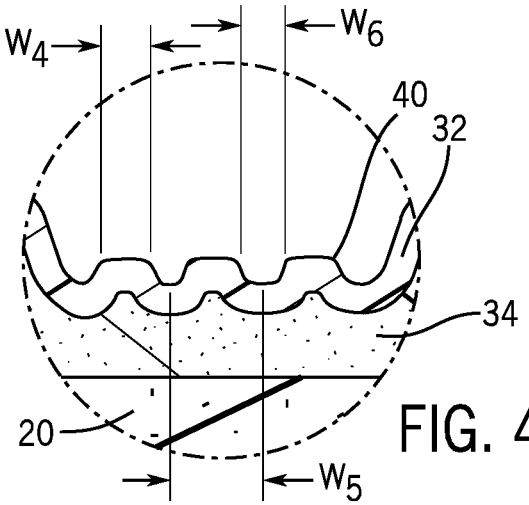
FIG. 4B is a cross-sectional view of a portion of the cover panel of the basketball taken along line 4B-4B of FIG. 4A.

Referring to FIGS. 3, 4A and 4B, the cover panels 22 of the cover assembly 14 can include first and second sets of spaced-apart projections 38 and 40. The first and second sets of spaced-apart projections 38 and 40 can be pebble-like projections, and can be convex, rounded and spaced apart from one another. The first and second sets of spaced-apart projections 38 and 40 further improve a player's ability to grip the basketball 10. The outer surface 32 of the cover panels 22 includes a valley base surface 42. The valley base surface 42 is the deepest part of the outer surface 32 of the cover panels. 22. The first and second sets of spaced-apart projections 38 and 40 extend or project radially outward from the valley base surface 42. The first and second sets of spaced-apart projections 38 and 40 project from the valley base surface 42 radially with respect to the center point 36 of the basketball 10. Each of the first and second sets of spaced-apart projections 38 and 40 include first and second outermost projection surfaces 44 and 46, respectively. The first and second sets of spaced-apart projections 38 and 40 form a multi-layered or multi-leveled pebbled texture to outer surface 32 of the cover panels 22 that improve the grip-ability and playability of the basketball 10. In one implementation, the first and second sets of spaced-apart projections 38 and 40 form a pebbled texture including irregularly, generally circular shaped pebbles.

The first set of spaced-apart projections 38 have a first average height, $H_1$. The first average height $H_1$ is measured in a radial direction with respect to the center point 36 from the valley base surface 42 to the first outermost projection surface 44. In one implementation, the first average height $H_1$ is within the range of 0.2 to 2.0 mm. The first set of spaced-apart projections also have an average width $W_1$. In one implementation, the average width $W_1$ is within the range of 1 to 5 mm. In another implementation, the first average height $H_1$ is within the range of 0.25 to 1.0 mm. In another implementation, the average width $W_1$ is within the range of 1.5 to 3.0 mm. Additionally, two projections of the first set of spaced-apart projections 38 can be spaced apart by a maximum width, $W_3$, within the range of 150 to 1000 μm (or 150 μm to 1 mm).

The second set of spaced-apart projections 40 form a micro level pattern or micro level pebbled texture. The second set of spaced-apart projections 40 form a finely textured surface that is perceptible to a human hand. The second set of spaced-apart projections 40, in conjunction with the first set of spaced-apart projections 38, provide an outer surface 32 of the cover panels 22 that improves the feel and playability of the basketball 10. The second set of spaced-apart projections 40 have a second average height, $H_2$. The second average height $H_2$ is measured in a radial direction with respect to the center point 36 from the valley base surface 42 to the second outermost projection surface 46. In one implementation, the second average height $H_2$ is within the range of 5 to 175 μm. The second set of spaced-apart projections 40 also have an average width $W_2$. In one implementation, the average width $W_2$ is within the range of 30 to 600 μm. In another implementation, the second average height $H_2$ is within the range of 25 to 150 μm. In another implementation, the average width $W_2$ is within the range of 20 to 500 μm. In one implementation, the second set of spaced-apart projections 40 can have an aspect ratio within the range of 0.2 to 5.0. The aspect ratio being the ratio of the maximum length to the maximum width of one of the first set of spaced-apart projections 40. In still other implementations, the heights and weights of the first set of projections 38 and/or the second set of projections 40 can include average heights $H_1$ and $H_2$, maximum widths $W_1$ and $W_2$, and maximum widths $W_3$ between two of the first set of spaced-apart projections 38 that fall outside of the ranges specified above.

Referring to FIG. 4B, the micro level pattern formed by the second set of spaced-apart projections 40 can form a unique set of projection ridge widths, groove widths and spatial periods. In one implementation, each of the second projections 40 of the second set of spaced-apart projections 40 can include a ridge width, $W_4$, within the range of 1 to 200 μm, a groove width, $W_6$, within the range of 1 to 200 μm, and a spatial period, $W_5$, within the range of 20 to 500 μm. In some implementations, the spatial period $W_5$ can be the same as the average width $W_2$. In one implementation, the second set of spaced-apart projections 40 can be micro-level extruded patterns or shapes formed on the outer surface 32 of the cover panels 22. These patterns or shapes can be processed onto the surface of materials by an embossing method, release paper method, vacuum formed, laser etching, lamination, or other method.

The sizes of micro level patterns of the second set of spaced-apart projections 40 can be easily sensed by mechanoreceptors on fingertips of players. The second set of spaced-apart projections 40 can enable a player to better feel the basketball and thus enable the player to better control the basketball. Anatomically, fingertips include four different types of mechanoreceptors. Two of four different types of the mechanoreceptors, the Merkel nerve endings and Meissner corpuscles, are located close to the surface of skin and are mainly used to monitor pressure, which is an important parameter for controlling grip. Meissner corpuscles typically have a width of 40 μm to 70 μm and Merkel discs typically have a diameter of 0.08 μm to 0.12 μm. Their receptive fields are also known to be highly sensitive. Thus, by providing micro level patterns/shapes on the surface of the basketball, the second set of spaced-apart projections 40 can enable a player to better feel the surface of the basketball 10 and control the basketball 10.

Figure 5:
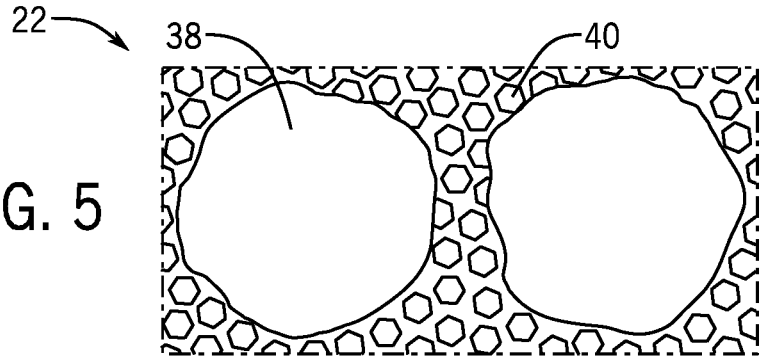
FIGS. 5 through 11 are top views of a portion of a cover panel of a basketball in accordance with alternative implementations of the present invention.
Figure 6:
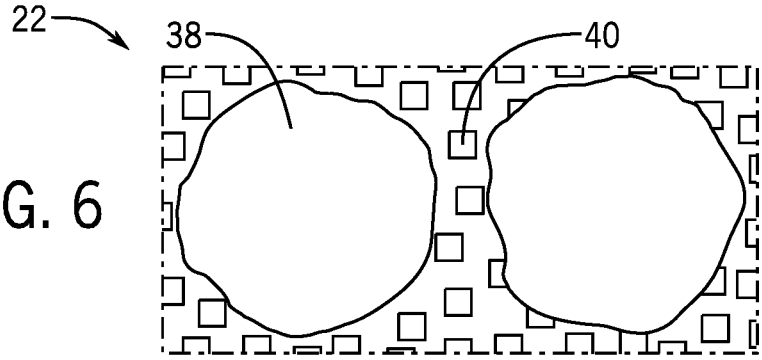
Figure 7:
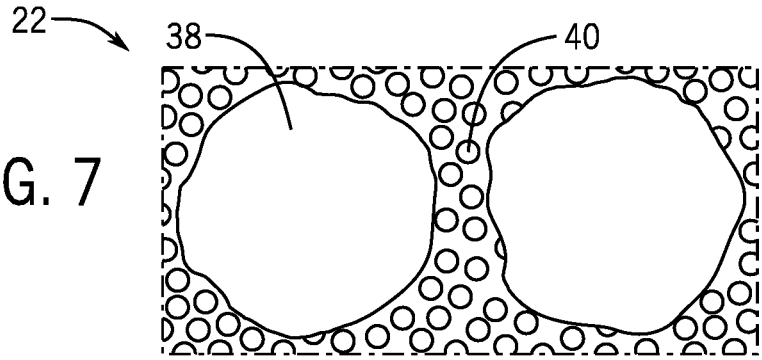
Figure 8:
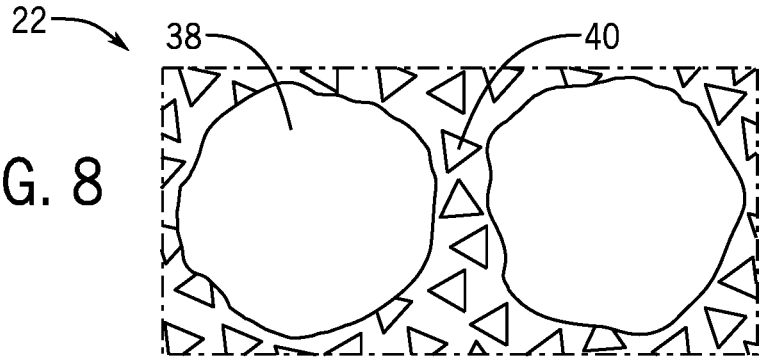
Figure 9:
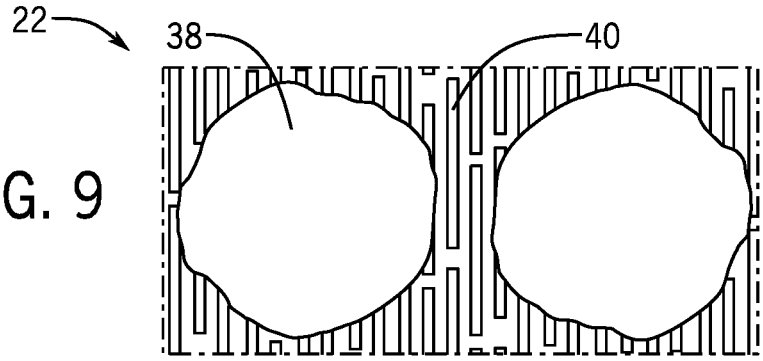
Figure 10:
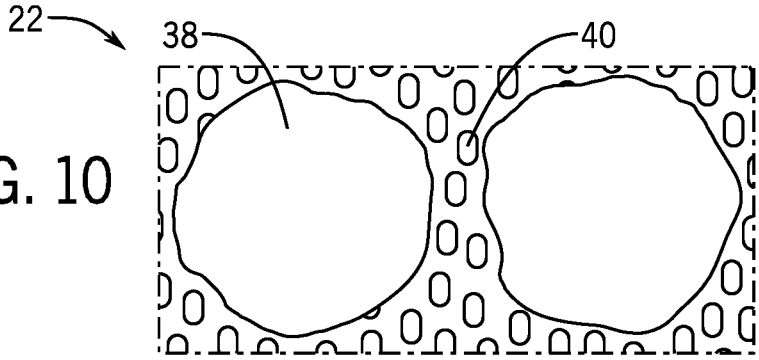
Figure 11:
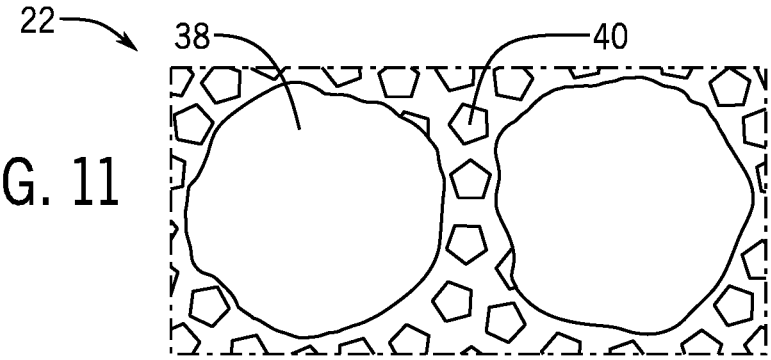

Referring to FIGS. 5 through 11, the first set of spaced-apart projections 38 can take a conventional pebble-like shape typically found on a conventional basketball having a pebbled outer surface, and the second set of spaced-apart projections 40 can take one of a variety of different shapes, or combinations of such shapes. FIGS. 5 through 11 illustrate some of the different shapes that the second set of spaced-apart projections 40 can take. One of skill in the art would understand that other shapes and combinations of the disclosed shapes or other shapes can be used to form the second set of spaced-apart projections. Referring to FIG. 5, the second set of projections 40 can have a generally hexagonal shape. Referring to FIG. 6, the second set of projections 40 can have a generally square shape. Referring to FIGS. 8, 9 and 11, the second set of spaced-apart projections 40 can have a triangular shape, a rectangular shape, and a pentagonal shape, respectively. In other implementations, the second set of spaced-apart projections 40 can take other generally polygonal shapes or combinations of such shapes. Referring to FIG. 7, the second set of spaced-apart projections 40 can have a generally circular shape, and referring to FIG. 10, the second set of spaced-apart projections 40 can have a generally ovular shape.

Figure 12:
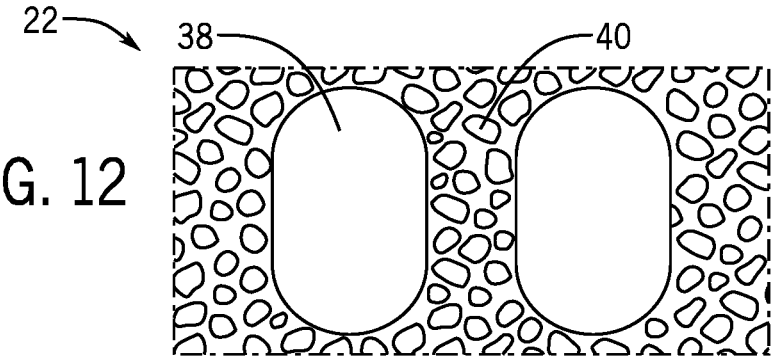
FIGS. 12 through 17 are top views of a portion of a cover panel of a basketball in accordance with additional alternative implementations of the present invention.
Figure 13:
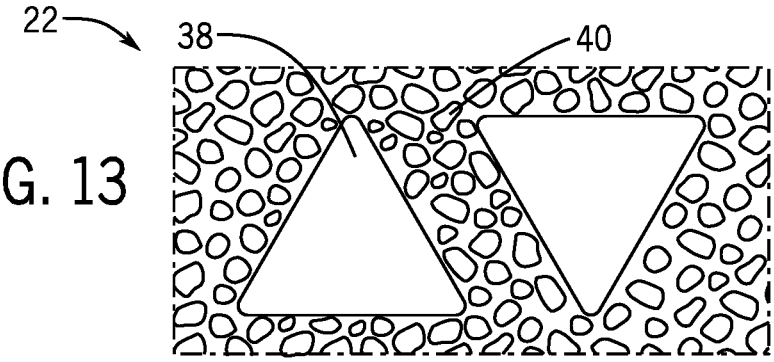
Figure 14:
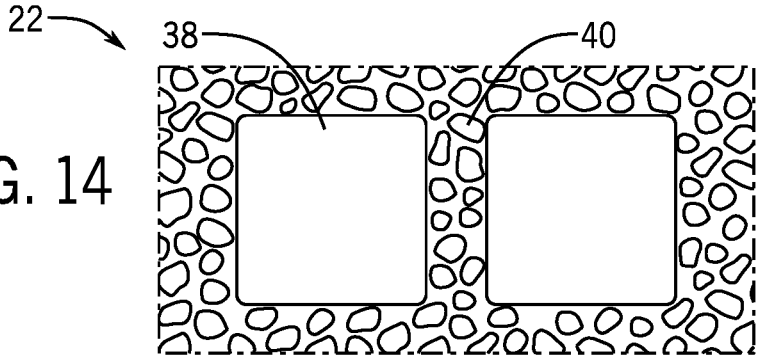
Figure 15:
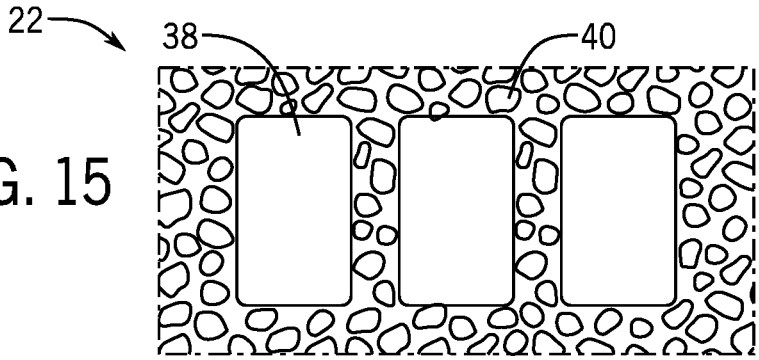
Figure 16:
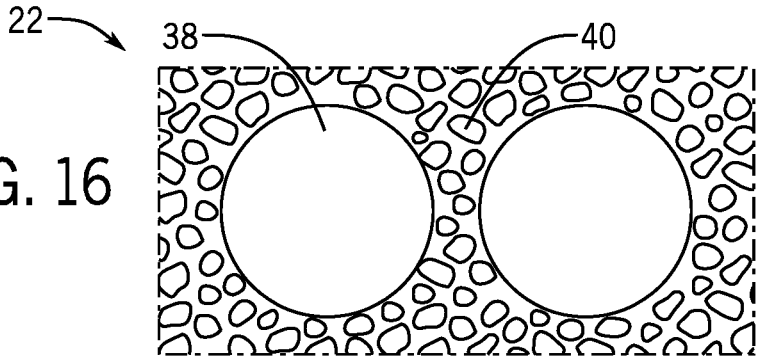
Figure 17:
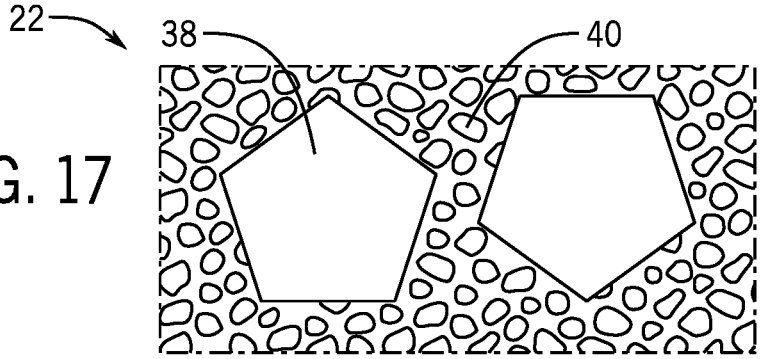

Referring to FIGS. 12 through 17, the second set of spaced-apart projections 40 can take a conventional pebble-like shape, and the first set of spaced-apart projections 38 can take one of a variety of different shapes, or combinations of such shapes. Referring to FIG. 12, the first set of spaced-apart projections 38 can have a generally ovular shape. Referring to FIG. 13, the first set of spaced-apart projections 38 can have a generally triangular shape. Referring to FIGS. 14, 15 and 17, the first set of spaced-apart projections 38 can have a square shape, a rectangular shape, and a pentagonal shape, respectively. In other implementations, the first set of spaced-apart projections 38 can take other generally polygonal shapes or combinations of such shapes. Referring to FIG. 16, the first set of spaced-apart projections 38 can have a generally circular shape. FIGS. 12 through 17 illustrate some of the different shapes that the first set of spaced-apart projections 38 can take. One of skill in the art would understand that other shapes and combinations of the disclosed shapes or other shapes can be used to form the first set of spaced-apart projections. It is also contemplated that any shape or combination of shapes can be used to form the first set of spaced-apart projections 38 in combination with any shape or combination of shapes of the second set of spaced-apart projections 40.

Figure 18:
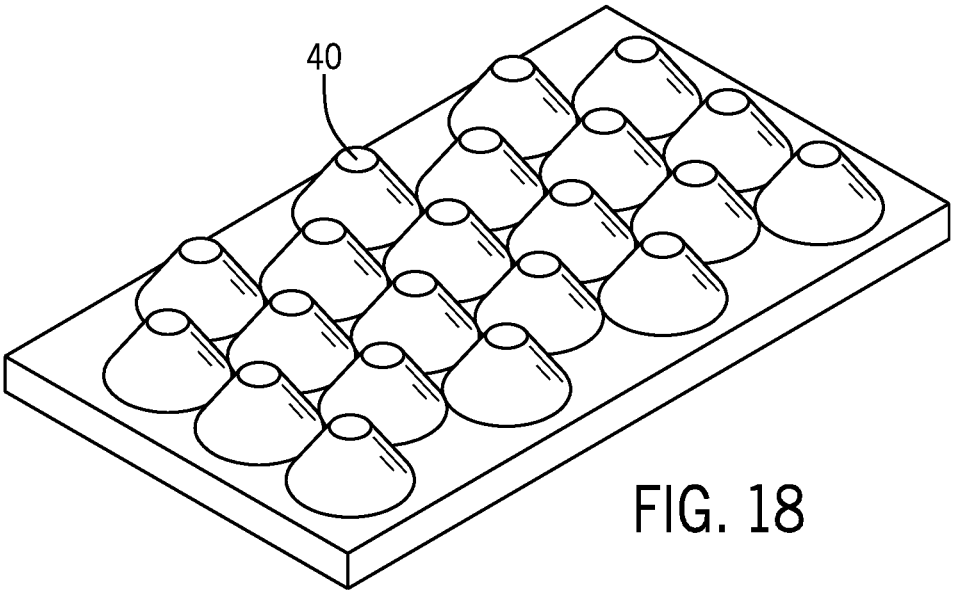
FIGS. 18 through 21 are top, side perspective views of a portion of a cover panel of a basketball in accordance with other additional alternative implementations of the present invention.
Figure 19:
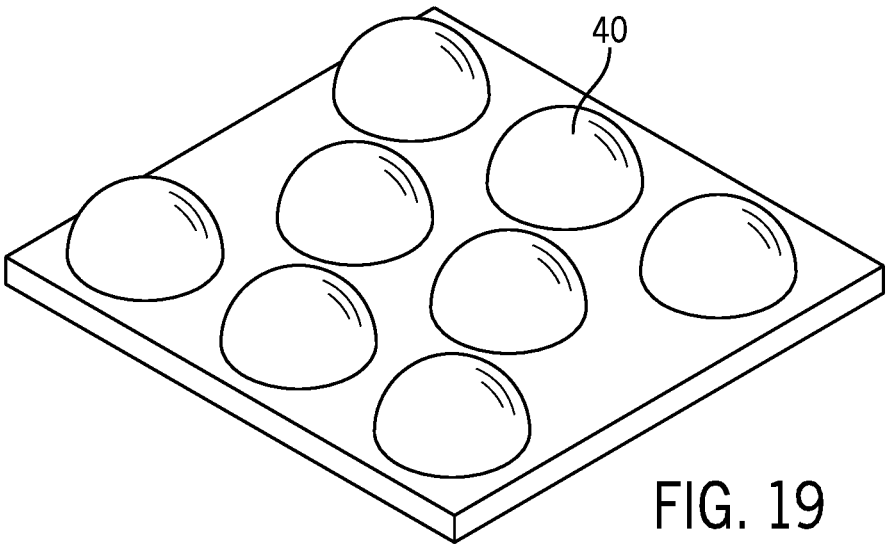
Figure 20:
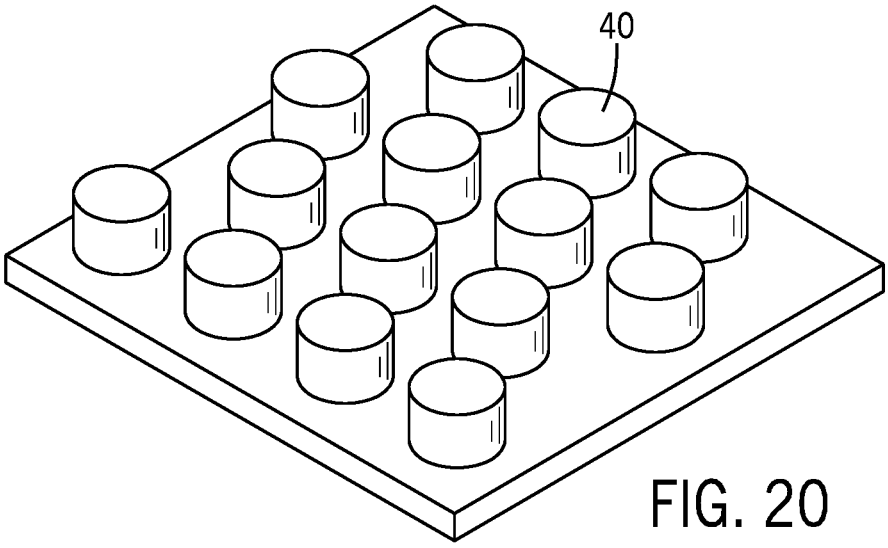
Figure 21:
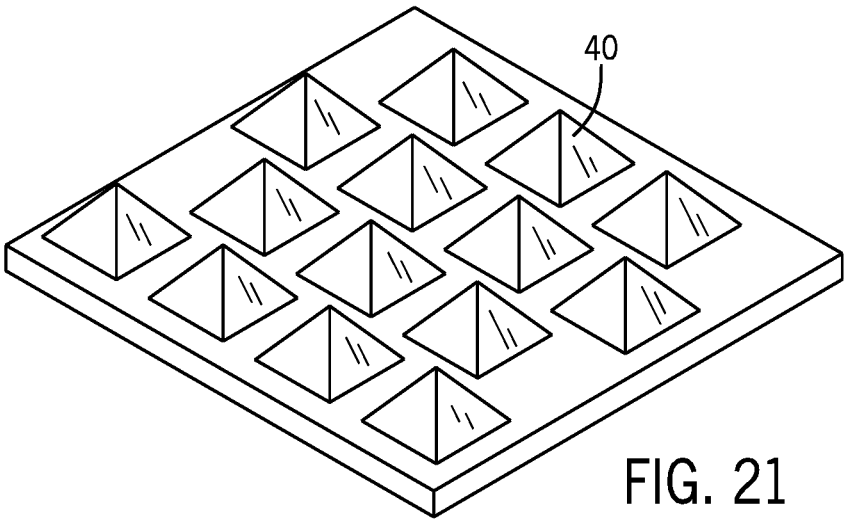

Referring to FIGS. 18 through 21, the second set of spaced-apart projections 40 have a three dimensional shape. Referring to FIG. 18, in one implementation, the shape of the second set of spaced-art projections 40 can take a generally truncated frusto-conical shape. Referring to FIG. 19, in one implementation, the shape of the second set of spaced-art projections 40 can take a generally hemi-spherical shape. Referring to FIG. 20, in one implementation, the shape of the second set of spaced-art projections 40 can take a generally cylindrical shape. Referring to FIG. 21, in one implementation, the shape of the second set of spaced-art projections 40 can take a generally pyramid shape. It is contemplated under the present invention that any shape of the second set of spaced-apart projections 40 discussed above with reference to FIGS. 4A through 11 can have a three dimensional shape that can be frusto-conical, cylindrical, hemi-spherical, pyramid type or other any other projecting shape, and combinations thereof.

In one implementation, the first and second sets of spaced-apart projections 38 and 40 can be generally evenly spaced in a consistent pattern across the valley base surface 42, or a portion thereof. In another implementation, the first and second sets of spaced-apart projections 38 and 40 can be randomly or inconsistently spaced apart, or arranged, about the valley base surface 42, or a portion thereof.

Referring to FIGS. 1 and 2, a plurality of elongated cover strips 50 can be positioned over the set of elongate channels 24. The cover strips 50 can have inner and outer surfaces, similar to the outer layer 32 and the backing 34 of the cover panels 22. In one implementation, the outer surface of the cover strips 50 also include the first and second sets of spaced apart projections 38 and 40. In another implementation, the cover strips 50 can include one of the first or second sets of spaced-apart projections 38 and 40. The cover strips 50 can be formed of a wear-resistant, resilient material having a high coefficient of friction value (or a high level of grip-ability). The material used to produce the cover strip 50 can be a natural rubber, a butyl rubber, natural leather, synthetic leather, a polyurethane, a thermoplastic material, a thermoset material, or other synthetic polymeric materials. The seam strips 50 can be applied before or after the carcass 12 is formed thereby can be included as part of the carcass or applied to the outer surface of the completed carcass through use of an adhesive or other conventional attaching means.

Figure 22:
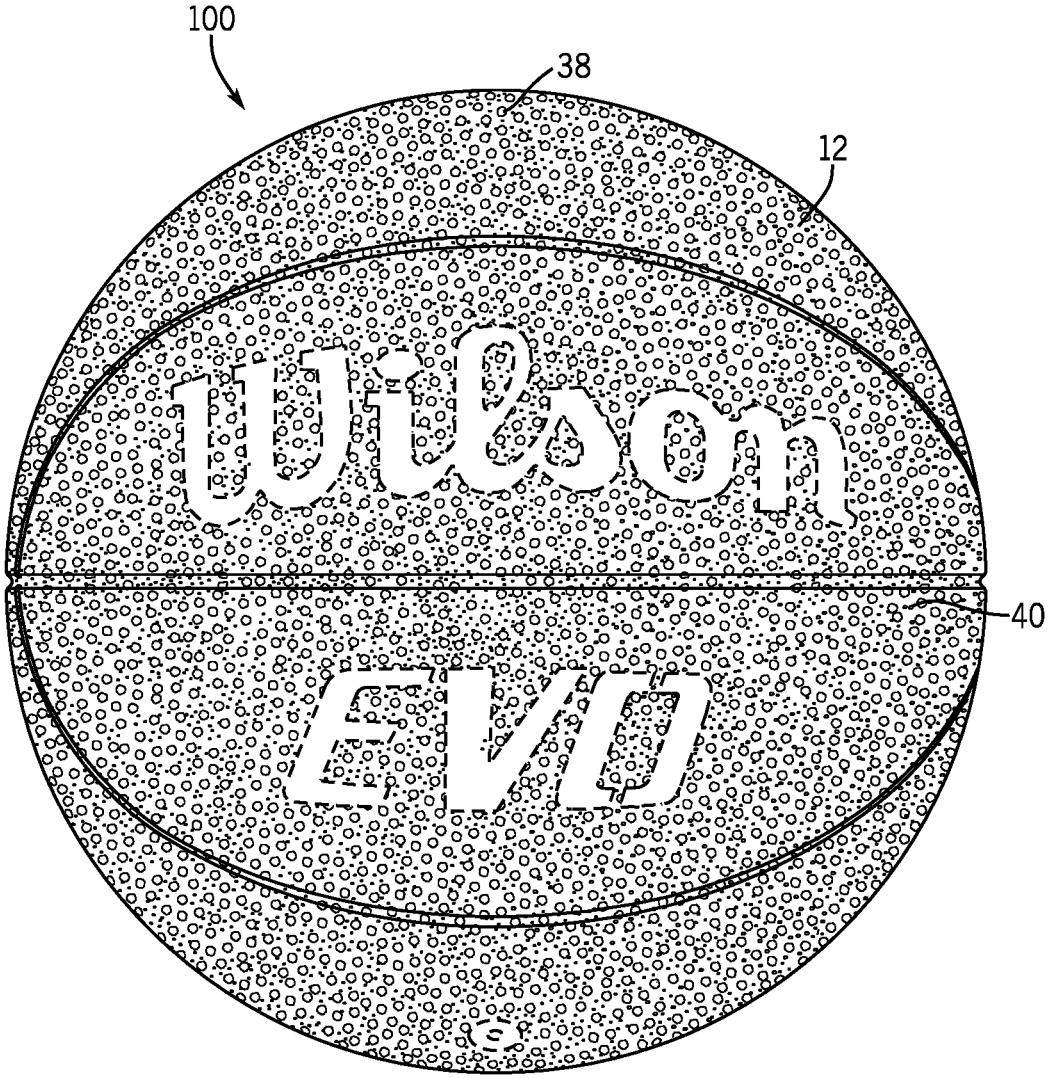
FIG. 22 is a front perspective view of a generally spherical basketball in accordance with another preferred embodiment of the present invention.

In other implementations, referring to FIG. 22, the basketball 100 can be formed without the cover assembly 14 or without the plurality of cover panels 22 and/or cover strips 50. In this implementation, the outer surface of the carcass 12 can include the first and second sets of projections 38 and 40. In such implementations, the characteristics of the first and second sets of spaced-apart projections 38 and 40 described above can be applicable, except that the first and second sets of spaced-apart projections 38 and 40 are formed on the outer surface of the carcass 12.

Many embodiments of the basketballs 10 built in accordance with the present application are specifically configured for providing optimum performance in all levels of competitive, organized play. For example, many embodiments of the basketballs built in accordance with the present application fully meet the basketball rules and/or requirements of one or more of the following basketball organizations: the Basketball Rules of the National Federation of State High School Associations ("NFHS"); the Basketball Rules and Interpretations of the National Collegiate Athletic Association ("NCAA"); and the Official Basketball Rules of the Federation International de Basketball Amateur ("FIBA"). Accordingly, the term "basketball configured for organized, competitive play" refers to a basketball that fully meets the basketball rules and/or requirements of, and is fully functional for play in, one or more of the above listed organizations.

Basketballs built in accordance with the present invention can improve a player's ability to easily grasp, handle, pass, shoot, dribble and otherwise control the ball during use without radically departing from the ball's traditional design. The improved maneuverability offered by the basketballs of the present invention can also assist in reducing turnovers. While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A generally spherical basketball defining a center point, the basketball comprising:

a carcass having an outer surface;

a cover assembly positioned over the outer surface of the carcass, the cover assembly including at least one cover panel, the at least one cover panel having an outer surface including a valley base surface and first and second sets of spaced-apart projections, each of the projections of the first and second sets of spaced-apart projections including first and second outermost surfaces, respectively, the first set of projections having an average height measured in a radial direction from the center point within the range of 0.2 to 2.0 mm from the valley base surface to the first outermost surface, the second set of projections having an average height measured in a radial direction from the center point within the range of 5 to 175 μm from the valley base surface to the second outermost surface, the second set of spaced-apart projections being positioned between and not being positioned over the first set of spaced-apart projections, the first set of projections extending over a majority of an outer surface of the at least one cover panel, each of at least two of the projections of the first set of projections being substantially enclosed on all sides by the projections of the second set of projections.

2. The basketball of claim 1, wherein the first set of spaced-apart projections are pebble-like projections having a pebbled outer surface that is free of any of the second set of spaced-apart projections.

3. The basketball of claim 1, wherein the second set of spaced-apart projections are pebble-like projections.

4. The basketball of claim 2, wherein the second set of spaced-apart projections are pebble-like projections.

5. The basketball of claim 1, wherein the first set of spaced-apart projections have an average height within the range of 0.25 to 1.0 mm from the valley base surface to the first outermost surface.

6. The basketball of claim 1, wherein the second set of spaced-apart projections have an average height within the range of 25 to 150 μm from the valley base surface to the second outermost surface.

7. The basketball of claim 5, wherein the second set of spaced-apart projections have an average height within the range of 25 to 150 μm from the valley base surface to the second outermost surface.

8. The basketball of claim 1, wherein the first set of spaced-apart projections have an average maximum width within the range of 1 to 5 mm, wherein the second set of spaced-apart projections have an average maximum width within the range of 30 to 600 μm, and wherein the first set of spaced-apart projections have an upper surface that is free of any of the second set of projections.

9. The basketball of claim 8, wherein the first set of spaced-apart projections have an average maximum width within the range of 1.5 to 3.0 mm, and wherein the second set of spaced-apart projections have an average maximum width within the range of 20 to 500 μm.

10. The basketball of claim 1, wherein two adjacent projections of the first set of projections are spaced apart from each other by a maximum width within the range of 150 to 1000 μm.

11. The basketball of claim 2, wherein the first set of pebble-like spaced-apart projections are selected from the group consisting of irregularly shaped pebble-like projections, hemi-spherically shaped pebble-like projections, generally oval shaped pebble-like projections, generally triangular shaped pebble-like projections, generally square shaped pebble-like projections, generally rectangular shaped pebble-like projections, generally diamond shaped pebble-like projections, generally pentagon-shaped pebble-like projections, other polygonal shaped pebble-like projections, generally conical pebble-like projections, generally frusto-conical pebble-like projections, generally cylindrical pebble-like projections, generally pyramid-shaped pebble-like projections, generally cubic pebble-like projections, and combinations thereof.

12. The basketball of claim 3, wherein the second set of pebble-like spaced-apart projections are selected from the group consisting of irregularly shaped pebble-like projections, hemi-spherically shaped pebble-like projections, generally oval shaped pebble-like projections, generally triangular shaped pebble-like projections, generally square shaped pebble-like projections, generally rectangular shaped pebble-like projections, generally diamond shaped pebble-like projections, generally pentagon-shaped pebble-like projections, other polygonal shaped pebble-like projections, generally conical pebble-like projections, generally frusto-conical pebble-like projections, generally cylindrical pebble-like projections, generally pyramid-shaped pebble-like projections, generally cubic pebble-like projections, and combinations thereof.

13. The basketball of claim 3, wherein each of the spaced-apart projections of the second set of projection has a maximum length and a maximum width, and wherein the maximum length and the maximum width define an aspect ratio of within 0.2 and 5.0.

14. The basketball of claim 1, wherein the outer surface of the carcass defines a first set of channels and a plurality of cover panel regions between the first set of channels, and wherein the at least one cover panel is a plurality of cover panels respectively positioned over the plurality of cover panel regions and spaced apart from each other.

15. The basketball of claim 14, wherein a plurality of elongated cover strips are positioned over the first set of channels, and wherein the cover strips have an outer surface.

16. The basketball of claim 15, wherein the outer surface of the elongated cover strips include the first set of spaced-apart projections.

17. The basketball of claim 15, wherein the outer surface of the elongated cover strips include the first and second sets of spaced-apart projections.

18. The basketball of claim 1, wherein the at least one cover panel is formed of at least a first material positioned at the outer surface of the at least one cover panel, and wherein the first material is selected from the group consisting of a natural rubber, a butyl rubber, natural leather, a polyurethane, a thermoplastic material, and a thermoset material.

19. The basketball of claim 1, wherein the carcass is formed of at least a bladder, a layer of windings about the bladder and at least one layer of elastomeric material formed over the layer of windings.

20. The basketball of claim 3, wherein the second set of pebble-like spaced-apart projections are generally circular shaped pebble-like projections.

* * * * *